US009587465B2

(12) United States Patent
Smith

(10) Patent No.: US 9,587,465 B2
(45) Date of Patent: Mar. 7, 2017

(54) DOWNHOLE DISCONNECT DEVICE AND METHOD OF OPERATION

(71) Applicant: Muchalls Oilfield Service Company Limited, Aberdeen (GB)

(72) Inventor: Iain W. Smith, Aberdeen (GB)

(73) Assignee: MUCHALLS OILFIELD SERVICE COMPANY LIMITED, Aberdeen (GB)

( * ) Notice: Subject to any disclaimer, the term of this patent is extended or adjusted under 35 U.S.C. 154(b) by 210 days.

(21) Appl. No.: 14/384,482

(22) PCT Filed: Mar. 18, 2013

(86) PCT No.: PCT/GB2013/050679
§ 371 (c)(1),
(2) Date: Sep. 11, 2014

(87) PCT Pub. No.: WO2013/140142
PCT Pub. Date: Sep. 26, 2013

(65) Prior Publication Data

US 2015/0129204 A1 May 14, 2015

(30) Foreign Application Priority Data

Mar. 19, 2012 (GB) ..... 1204742.9

(51) Int. Cl.
*E21B 41/00* (2006.01)
*E21B 17/06* (2006.01)
(Continued)

(52) U.S. Cl.
CPC ..... *E21B 41/00* (2013.01); *E21B 17/06* (2013.01); *E21B 31/00* (2013.01); *E21B 44/005* (2013.01); *E21B 47/09* (2013.01); *E21B 47/122* (2013.01)

(58) Field of Classification Search
None
See application file for complete search history.

(56) References Cited

FOREIGN PATENT DOCUMENTS

EP 2381063 A2 10/2011
WO 2009002181 A1 12/2008
(Continued)

OTHER PUBLICATIONS

International Search Report and Written Opinion dated Nov. 7, 2013 for PCT/GB2013/050679.

*Primary Examiner* — Kenneth L Thompson
*Assistant Examiner* — Caroline Butcher
(74) *Attorney, Agent, or Firm* — Abel Law Group, LLP

(57) ABSTRACT

A downhole disconnect device for disconnecting an intervention tool string from a wireline, includes: a tubular body having a first part directly or indirectly coupleable to the wireline and a second part connectable directly or indirectly to an intervention tool string; an actuator for disconnecting the second part of the tubular body from the first part of the tubular body; at least one sensor to detect when the tool string is stuck in use and to produce an output signal accordingly; a controller configured to receive the output signal and selectively operate the actuator accordingly; and a power source. The tubular body is adapted to house the actuator, sensor, controller and power source and the device further comprises a timer configured to delay operation of the actuator by a predetermined time on receipt of the output signal from the sensor. There is also a method of operating the downhole disconnect device.

28 Claims, 9 Drawing Sheets

(51) Int. Cl.

| | |
|---|---|
| ***E21B 31/00*** | (2006.01) |
| ***E21B 44/00*** | (2006.01) |
| ***E21B 47/09*** | (2012.01) |
| ***E21B 47/12*** | (2012.01) |

(56) References Cited

FOREIGN PATENT DOCUMENTS

| | | | | |
|---|---|---|---|---|
| WO | 2010061231 | A1 | 6/2010 | |
| WO | WO 2013133796 | A1 * | 9/2013 | ..... E21B 17/06 |

* cited by examiner

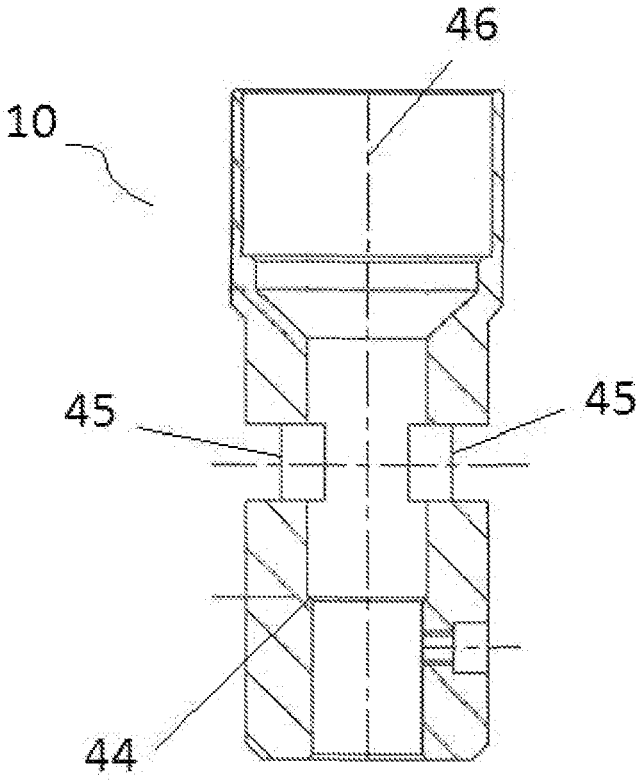
Figure 5
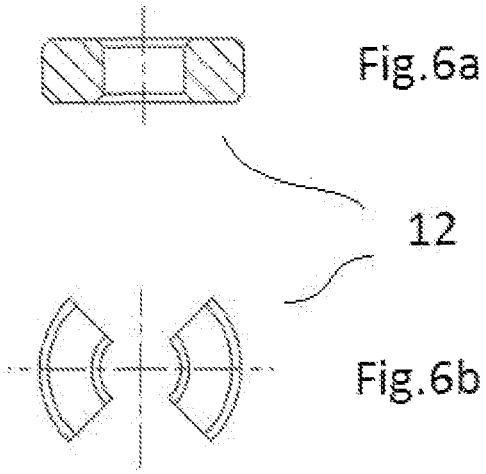

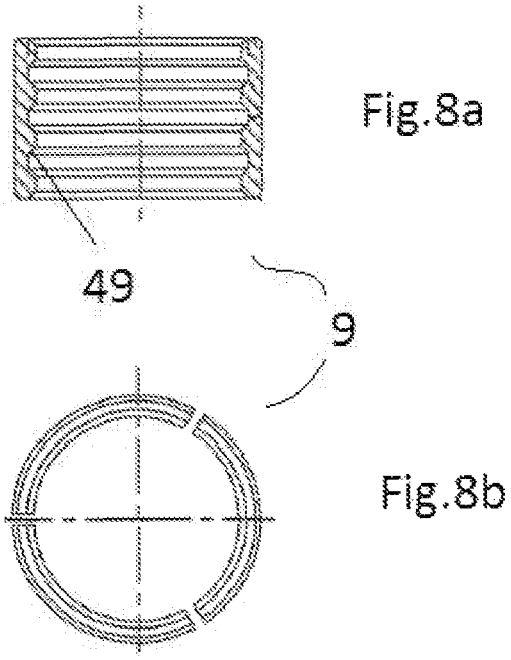
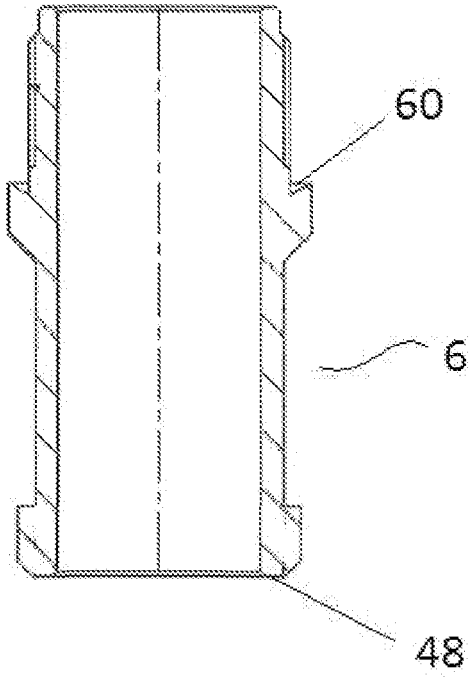
Figure 9

DOWNHOLE DISCONNECT DEVICE AND METHOD OF OPERATION

The present invention relates generally to wellbore tools and operations and more specifically to a disconnect device for use when a wellbore intervention tool becomes stuck in use.

In the oil and gas industries, intervention tools are typically lowered into a pre-drilled and lined wellbore on the end of a wireline, coiled tubing or snubbing to perform intervention operations. A wireline may consist of a so-called 'slickline' or a braided line typically of the coreless or electric line variety. Coiled tubing is used when it is desired to pump chemicals directly to the bottom of the well, such as in a circulating operation or a chemical wash. It can also be used for tasks normally done by wireline if the deviation in the well is too severe for gravity to lower the 'toolstring' including the intervention tool.

Disconnect devices are known to separate an intervention tool from a tool string if, for example, the tool becomes stuck in the well. Known methods for disconnecting a tool string from a stuck tool include applying a high tensile load to the wireline to shear a pin located on the tool or bottom hole assembly (BHA) making up the toolstring to disconnect the wireline therefrom. However, the shear pin must be designed to shear at a relatively low tensile load to accommodate the relatively weak electrical wire of a braided wireline, for example. This weak point presents its own disadvantages including unintended disconnection if the tensile load accidentally exceeds the threshold of the pin. Alternatively, a cutter may be sent down to sever the wireline to release it from the BHA or toolstring. However, known cutting tools are inefficient and can often fail to locate and/or sever a wireline, particularly when used in a deviated or horizontal wellbore. Furthermore, both these known disconnect methods require repair or replacement of the wireline or shear pin which in itself requires expensive downtime and replacement component cost. Where coiled tubing is used, it is known for a drop ball or similar to be hydraulically pumped/forced down the tubing to engage with a disconnect member to release the tubing from the BHA and tool. However, it is not always desirable to use coiled tubing, particularly in light of its increased cost relative to that of the less expensive wireline.

A further disadvantage of such methods of disconnect is they require mechanical intervention by an operator and are also prone to accidental disconnect which results in significant downtime and undesirable expense.

Once the tool string has been disconnected from the tool, the operators can then attempt to recover the stuck tool with a "fishing" tool. However, in situations where recovery of the tool is impractical or impossible, the stuck tool will be undesirably abandoned. This is of course significantly costly for the well operator so recovery of the tool is paramount. Such an abandonment situation may occur where a secure connection of the fishing tool with the stuck BHA is not possible. However, many known methods of disconnect do not provide a suitable engagement surface for a standard fishing tool to attach.

A first aspect of the present invention provides a downhole disconnect device for disconnecting an intervention tool string from a wireline, said device comprising:—

- a tubular body having a first part directly or indirectly coupleable to the wireline and a second part connectable directly or indirectly to an intervention tool string;
- an actuator for disconnecting the second part of the tubular body from the first part of the tubular body;

- at least one sensor to detect when the tool string is stuck in use and to produce an output signal accordingly;
- a controller configured to receive the output signal and selectively operate the actuator accordingly; and
- a power source;
- wherein the tubular body is adapted to house the actuator, sensor, controller and power source and wherein the device further comprises a timer configured to delay operation of the actuator by a predetermined time on receipt of the output signal from the sensor.

Importantly, the present invention provides a downhole disconnect device which is adapted to provide automatic disconnect of an intervention tool when the same becomes stuck. All the components of the device are onboard so no surface electric connection is required and the device requires no operator interaction from the surface so human error is completely eliminated from the disconnect operation. Furthermore, the risk of an electric signal (sent from the surface to operate the downhole disconnect device) being lost by interference from components of the wellbore and/or the large distances involved in such operations is eliminated. The timer may be set to delay operation of the actuator by a predetermined time on receipt of the output signal from the sensor indicating the intervention tool is stuck. Suitably such a time period may be 5-8 hours for example, so that when the sensor detects the intervention tool is stuck, such as by sensing no movement of the downhole disconnect device, and sends an output signal to the controller accordingly, the timer delays operation of the actuator and therefore disconnection for the predetermined amount of time. This allows a pause in intervention activities for a short period of time relative to the predetermined delay time whilst avoiding unintentional disconnect of the intervention tool from the first part of the downhole disconnect device. Where the downhole disconnect device remains motionless for the entire predetermined time, the controller automatically operates the actuator and the first part of the downhole disconnect device is disconnected from the second part and therefore the stuck intervention tool allowing the uncompromised first part of the downhole disconnect device and wireline to be removed from the wellbore and leaving the second part and intervention tool therein for a fishing tool to later recover.

The wireline may be a standard wireline, slickline or electric line.

Preferably at least the actuator is axially arranged in the body. Preferably the sensor, power source and actuator are axially aligned within the tubular body. This ensures the device and toolstring are compact and balanced during well intervention operations.

Suitably the sensor may comprise an accelerometer or similar motion sensor which is capable of detecting a stuck intervention tool. The sensor may detect a lack of movement when the tool is stuck or a vibration caused by jarring when an operator is attempting to free the tool. The sensor will then output a signal to the controller which receives the same and activates the timer placing the device into a 'timer mode'. Alternatively, the sensor may be adapted to send a signal to the controller during operation when movement and vibrations are frequent but when no movement or vibration occurs, the controller is configured to detect a lack of output signal from the sensor and switches the device into 'timer mode' by activating the timer. If no movement or vibration is detected by the sensor and no corresponding signal is sent to the controller for a predetermined time, the device automatically switches into 'disconnect mode' and the controller operates the actuator to automatically disconnect the device from the tool.

Preferably the timer is programmable to allow the timer to be selectively programmed to a predetermined time period. Suitably the predetermined time period may be between five to eight hours, for example.

Preferably the actuator comprises an electrical actuator and the power source comprises a battery. Suitably the actuator may comprise a solenoid. Preferably the downhole disconnect device further comprises a disconnect mechanism and preferably the actuator comprises an electrical motor which drives the disconnect mechanism to disconnect the second part from the first part. Suitably the motor may be coupled to the disconnect mechanism by one or more gears. Suitably the device comprise a gearbox provided between the motor and the disconnect mechanism.

Preferably the device comprises an attachment member provided at an upper end of the tubular body, suitably at the upper end of the first part, for attaching a wireline directly thereto. Suitably the attachment member may be coupled to and integral with the tubular body and preferably with the first part. Preferably the attachment member is axially aligned with the tubular body. Suitably the attachment member may comprise a rope socket connected to the first part of the body. Suitably the rope socket may be received by the first part of the body and secured therein by suitable means such as a pin or screw, for example.

Suitably, the first part comprises a first tubular body and the second part comprises a second tubular body.

Preferably the tubular body comprises the first tubular body releasably connected to the second tubular body where, in use in a vertical wellbore, the second body is disposed below the first body. Preferably at least the actuator, power source, sensor and controller are housed in the first body and the disconnect mechanism is at least partially housed in the second body.

Preferably the actuator is a motor which rotatably drives a drive shaft engageable with the disconnect mechanism. The drive shaft may extend from a second end of the first tubular body to engage with the disconnect mechanism. Suitably the drive shaft may be supported by one or more bearings. The disconnect mechanism may extend from a first end of the second tubular body.

Preferably the disconnect mechanism comprises an axially disposed elongate member having a first end engageable with the drive shaft and a second end.

Preferably the elongate member is slidably mounted in at least the second tubular body to move in an axial direction. Preferably the elongate member is prevented from rotating by a constraint. Suitably the constraint may comprise a spline arrangement or a pin or similar engageable in a longitudinal slot of the elongate member to prevent rotation whilst allowing for axial movement.

Preferably the first end of the elongate member comprises a threaded bore corresponding to a screw thread on the drive shaft. Suitably the drive shaft may comprise a worm gear. This arrangement causes the elongate member to move in an axial direction on rotation of the drive shaft by the motor.

Preferably the elongate member is further supported by the first tubular body when the first and second tubular bodies are connected. Suitably the first tubular body may comprise a reduced elongate portion which is received by the second tubular body to allow the first and second bodies to slideably engage with each other. Suitably the reduced elongate portion of the first body may support and guide the elongate member of the disconnect mechanism when the first and second tubular bodies are connected and during disconnection.

Preferably the disconnect mechanism comprises at least one locking member to lock the first and second tubular bodies together during normal operating conditions. Suitably the elongate member may engage with the locking member to move the same from a locked position to an unlocked position and vice versa. Suitably the at least one locking member may comprise one of more annular members which engage with corresponding recesses inside the second tubular body. Such recesses may be provided by shoulders machined on the inside surface of the second tubular body. The annular members may be spring members which are forced outwardly into their corresponding recesses by an enlarged portion of the elongate member when the same is moved axially by the motor. Alternatively, the elongate member may comprise a reduced portion having a reduced diameter, for example, into which the annular members may fall laterally into when the reduced portion is moved adjacent to the annular members by the motor. Such a configuration has the same effect as an enlarged portion of the elongate member to force the annular members outwardly again when the reduced portion is moved axially away from the annular members to move the same out of lateral alignment.

Alternatively and preferably the disconnect mechanism comprises a locking sleeve slideably and axially arranged inside the second tubular body and having a throughbore to slideably receive the second end of the elongate member. Preferably a first end of the locking sleeve is adapted to receive a portion of the second reduced end of the first tubular body when the first and second tubular bodies are connected. Suitably the locking member is arranged between the reduced (second) end portion of the first tubular body and the first end of the locking sleeve. Suitably the locking member slideably engages with an inside surface of the locking sleeve whilst being lockably engagable with the first tubular body when the device is in a connected state. Suitably the locking member is constrained in an axial direction by an annular shoulder of the locking sleeve and a first annular shoulder of the second tubular body.

Preferably the locking member comprises a plurality of ridges to define a plurality of channels which correspond to annular ridges and channels on the outer of the reduced portion of the first tubular body. Suitably the locking segments may comprise two arcuate locking segments each extending about approximately 180 degrees relative to a longitudinal axis of the device. Preferably the locking segments comprise three locking segments each extending about approximately 120 degrees relative to the longitudinal axis of the device.

Preferably the locking sleeve is coupled to the elongate member thereby to move axially therewith when driven by the motor. When the locking sleeve is moved axially with the elongate member, the first end of the sleeve slideably moves over the locking segments mounted therein. On further movement of the locking sleeve away from the reduced portion of the first tubular body and the locking segments mounted therearound, an annular space is formed between the first end of the locking sleeve and the first annular shoulder of the second tubular body, i.e. where the locking sleeve was when the device was in a fully connected state. The locking segments are suitably unconstrained in a lateral direction to thereby move laterally outwards and away from the elongate member to fill the annular space. The first tubular body can then be moved axially out of and away from the second tubular body and safely hauled to the surface by the wireline. Desirably the second tubular body remains connected with the stuck intervention tool whilst providing a clean industry standard fish neck for a subsequently and separately run in fishing tool to securely engage for efficient tool recovery. The second part may be provided with a centraliser mechanism to centralise the second part within the well to aid subsequent fishing/recovery of the second part and intervention tool.

Preferably the disconnect mechanism is adapted to axially move the locking sleeve a limited distance corresponding to the space required for the locking segments to move laterally outwardly in the annular space whilst providing a limit to the locking segments in the axial direction. Suitably the first end of the locking sleeve may provide this axial limit when the segments are in an outwardly unlocked position. Suitably a second annular shoulder inside the second tubular body may provide the limit of axial movement of the locking sleeve away from the locking segments.

Preferably the disconnect mechanism further comprises a secondary locking means. A secondary locking means suitably provides for increased security when the first tubular body is connected with the second tubular body during normal operating conditions. Suitably the secondary locking means comprises at least one retaining member mounted in a corresponding lateral through slot of the locking sleeve. Preferably the retaining member is free in a lateral direction relative to a longitudinal axis of the device whilst being constrained axially by the lateral slot. Preferably the retaining member is outwardly moveable in the lateral direction from a deployed position to a retracted position and vice versa. Preferably the retaining member engages with the second shoulder of the second tubular body when in the deployed position thereby to prevent the locking sleeve moving axially away from the first tubular body which would otherwise allow the locking members to move outwardly away from the first tubular body and disconnect the same from the second tubular body. When the retaining member is in the retracted position the locking sleeve is suitably unconstrained in the axial direction to move away from the first tubular body.

Preferably the at least one retaining member is slideably engaged with the elongate member. Suitably the retaining member is moved outwardly in its lateral slot by the elongate member when the same is moved axially by the motor. Suitably the elongate member may comprise an enlarged portion which engages with the retaining member to force the same outwardly towards the deployed position. Alternatively or additionally, the elongate member may comprise a reduced portion having a reduced diameter, for example, into which the annular members may fall laterally into when the reduced portion is moved adjacent to and in lateral alignment with the annular members by the motor. Such a configuration has the same effect as an enlarged portion of the elongate member to force the annular members outwardly when the reduced portion is moved axially away from the annular members to move the same out of lateral alignment. Preferably two reduced portions of the elongate member define a projecting portion therebetween.

The retaining member may be an annular spring collar which is biased towards the retracted position and forced outwardly by the elongate member towards the deployed position. Alternatively and preferably, the retaining member comprises at least two retaining members each mounted in corresponding lateral slots of the locking sleeve and arranged opposite each other relative to a longitudinal axis of the device. Suitably each retaining member may be arcuate and extend about approximately ninety degrees relative to the longitudinal axis of the device.

Preferably the elongate member comprises a longitudinal slot provided between the projecting portion and its second end for a cap screw to engage. The cap screw prevents the locking sleeve rotating on the elongate member whilst allowing the elongate member to move axially relative to the locking sleeve. Suitably the length of the slot determines the axial travel of the elongate member relative to the locking sleeve. When a limit of the slot engages with the cap screw as the elongate member is moved axially relative to the locking sleeve, the locking sleeve will be moved with the elongate member towards a second end of the second tubular body.

Suitably an internal shoulder of the locking sleeve may also provide a limit to the elongate member when moving relative to the locking sleeve. Preferably the shoulder is adapted to engage with the enlarged portion of the elongate member after retraction of the retaining members so that on engagement with the shoulder the locking sleeve is moved with the elongate member towards the second end of the second tubular body.

Preferably the first end of the second tubular body comprises a standard connection for a fishing tool to engage with. Preferably the first end of the second body comprises an industry standard fish neck. This allows a subsequently and separately run in standard fishing tool to easily and quickly engage with the second tubular body of the device which remains coupled with the stuck intervention tool to allow for efficient recovery of the same.

Suitably a second end of the second tubular body may comprise a screw thread for receiving and connecting to a corresponding screw thread of a bottom assembly or an intervention tool.

Suitably the device may further comprise a recovery alarm system which indicates when a tool string comprising an intervention tool has reached/passed ground level. Suitably the device may comprise a further sensor for detecting when the device has reached/passed ground level to alert an operator accordingly. The further sensor may be housed in the tubular body to cooperate with one or magnets or similar arranged in the well bore at or near ground level. Alternatively the device may comprise one or more magnets or similar which a sensor arranged in the well bore at or near ground level detects when the device passes. Suitably the further sensor is adapted to transmit a signal to an alarm to operate the same and alert an operator accordingly. Preferably such transmission is via wireless communication.

Suitably the device may further comprise electrical instrumentation for performing specific intervention operations such as measuring well pressure and/or temperature for example.

A further aspect of the present invention provides a method of disconnecting a stuck intervention tool from a part of a downhole disconnect device as described above, the method comprising the steps of:

- sensing when the tool is stuck in a well bore;
- transmitting an output signal from the sensor to the controller;
- delaying operation of the actuator by a predetermined time on receipt of the output signal by the controller;
- automatically operating the actuator on expiry of the predetermined time to disconnect the first part of the tubular body from the second part of the tubular body.

The method may further comprise one or more of the following steps:

recovering the first part of the device to ground level;

lowering a fishing tool to the second part and/or the stuck intervention tool;

engaging the fishing tool with the second part and/or the intervention tool;

recovering the fishing tool and second part and/or intervention tool to ground level; and detecting when the device and/or fishing tool and/or intervention tool has reached/passed ground level during a corresponding recovery step.

A further aspect of the present invention provides a drive assembly for use in a downhole tool, the drive assembly comprising a motor axially mounted in a first tubular body having a drive shaft engageable with an elongate member slideably mounted in the tubular body, whereby rotation of the drive shaft by the motor causes axial movement of the elongate member, and wherein the elongate member is coupleable with at least one driven member to move the same between a retracted position and a deployed position.

Optionally, a joint may be provided between the drive shaft and the elongate member and/or between the motor and the drive shaft and further optionally, said joint may be flexible and/or may be a universal joint allowing a degree of flexibility in the alignment of said components.

The drive shaft may connect to a protruding or male output rotor of the motor or the drive shaft may be inserted into a recessed or box output rotor of the motor for possible additional robustness in the field.

Suitably the assembly may comprise a power source disposed in the tubular body.

Suitably a sensor may be disposed in the tubular body for detecting when the device is motionless and transmitting an output signal based thereon to operate the motor accordingly.

Suitably a controller may be disposed in the tubular body for receiving the output signal and configured to delay operation of the motor on receipt of the output signal by a predetermined time.

As described above, the tubular body may comprise two parts and the motor may be provided in a first tubular part and the elongate member may be provided in a second tubular part, the two parts being disconnectable on operation of the motor. In this case, the driven member may engage with the second tubular part when in the deployed position to connect the two body parts together.

Alternatively, the driven member may comprise one or more locking keys which extend from the tubular body when in a deployed position. The locking keys may extend laterally from the tubular body to engage with an inner surface of a tubing lining a wellbore thereby to anchor the tubular body therein. A subassembly comprising one or more gauges may be attachable to the tubular body to position the same in the vicinity of perforations formed in the wall lining to allow the gauges to measure flow rates of oil or gas entering the tubing and/or the wellbore, for example.

Alternatively, the driven member may comprise one or more latch members which are adapted to engage with a fishing neck of a stuck intervention tool to allow the same to be recovered.

A further aspect of the present invention provides a downhole disconnect device for disconnecting a run in member from an intervention tool, the device comprising:

a motor axially mounted in a first tubular body having a drive shaft extending from a first end thereof;

a power source disposed in the first tubular body;

a sensor disposed in the first tubular body for detecting when the device is motionless and transmitting an output signal based thereon;

a controller disposed in the first tubular body for receiving the output signal and configured to delay operation of the motor on receipt of the output signal by a predetermined time;

wherein the drive shaft is engageable with a disconnect member slideably mounted and axially arranged in a second tubular body of the device whereby rotation of the drive shaft by the motor causes axial movement of the disconnect member; the disconnect member being coupled to at least one locking member engageable with the second tubular body when in a deployed position to connect the first and second tubular bodies together, whilst allowing the first and second tubular bodies to be disconnected when the locking member is in a retracted position; the first tubular body being connectable to a run in member and the second tubular body being coupleable to an intervention tool.

Typically the run in member may be a standard wireline, slickline or electric wire, for example, or a tubular string such as coiled tubing or drill pipe string.

Suitably the drive shaft may be supported in the first tubular body by one or more bearings. The disconnect member may extend from a first end of the second tubular body which engages with the first tubular body.

Preferably the disconnect member comprises an axially disposed elongate member having a first end engageable with the drive shaft and a second end.

Preferably the elongate member is prevented from rotating by a constraint. Suitably the constraint may comprise a spline arrangement or a pin or similar engageable in a longitudinal slot of the elongate member to prevent rotation whilst allowing for axial movement.

Preferably the first end of the elongate member comprises a threaded bore corresponding to a screw thread on the drive shaft. Suitably the drive shaft may comprise a worm gear. This arrangement causes the elongate member to move in an axial direction on rotation of the drive shaft by the motor.

Preferably the elongate member is further supported by the first tubular body when the first and second tubular bodies are connected. Suitably the first tubular body may comprise a reduced elongate portion which is received by the second tubular body to allow the first and second bodies to slideably engage with each other. Suitably the reduced elongate portion of the first body may support and guide the elongate member of the disconnect mechanism when the first and second tubular bodies are connected and during disconnection.

Suitably the at least one locking member may comprise one of more annular members which engage with corresponding recesses inside the second tubular body. Such recesses may be provided by shoulders machined on the inside surface of the second tubular body. The annular members may be spring members which are forced outwardly into their corresponding recesses by an enlarged portion of the elongate member when the same is moved axially by the motor.

Alternatively and preferably the disconnect device further comprises a locking sleeve slideably and axially arranged inside the second tubular body and having a throughbore to slideably receive the second end of the elongate member. Preferably a first end of the locking sleeve is adapted to receive a portion of the second reduced end of the first tubular body when the first and second tubular bodies are connected. Suitably the locking member is arranged between the reduced end portion of the first tubular body and the first end of the locking sleeve. Suitably the locking member slideably engages with an inside surface of the locking sleeve whilst being lockably engagable with the first tubular body when the device is in a connected state. Suitably the locking member is constrained in an axial direction by an annular shoulder of the locking sleeve and a first annular shoulder of the second tubular body.

Preferably the locking member comprises a plurality of ridges to define a plurality of channels which correspond to annular ridges and channels on the outer of the reduced portion of the first tubular body. Suitably the locking segments may comprise two arcuate locking segments each extending about approximately 180 degrees relative to a longitudinal axis of the device. Preferably the locking segments comprise three locking segments each extending about approximately 120 degrees relative to the longitudinal axis of the device.

Preferably the locking sleeve is coupled to the elongate member thereby to move axially therewith when driven by the motor. When the locking sleeve is moved axially with the elongate member, the first end of the sleeve slideably moves over the locking segments mounted therein. On further movement of the locking sleeve away from the reduced portion of the first tubular body and the locking segments mounted therearound, an annular space is formed between the first end of the locking sleeve and the first annular shoulder of the second tubular body, i.e. where the locking sleeve was when the device was in a fully connected state. The locking segments are suitably unconstrained in a lateral direction to thereby move laterally outwards and away from the elongate member to fill the annular space. The first tubular body can then be moved axially out of and away from the second tubular body and safely hauled to the surface by the wireline. Desirably the second tubular body remains coupled with the stuck intervention tool whilst providing a clean industry standard fish neck for a subsequently and separately run in fishing tool to securely engage for efficient tool recovery.

Preferably the elongate member is adapted to axially move the locking sleeve a limited distance corresponding to the space required for the locking segments to move laterally outwardly in the annular space whilst providing a limit to the locking segments in the axial direction. Suitably the first end of the locking sleeve may provide this axial limit when the segments are in an outwardly unlocked position. Suitably a second annular shoulder inside the second tubular body may provide the limit of axial movement of the locking sleeve away from the locking segments.

Preferably the disconnect member comprises a secondary locking means. A secondary locking means suitably provides for increased security when the first tubular body is connected with the second tubular body during normal operating conditions. Suitably the secondary locking means comprises at least one retaining member mounted in a corresponding lateral through slot of the locking sleeve. Preferably the retaining member is free in a lateral direction relative to a longitudinal axis of the device whilst being constrained axially by the lateral slot. Preferably the retaining member is outwardly moveable in the lateral direction from a deployed position to a retracted position and vice versa. Preferably the retaining member engages with the second shoulder of the second tubular body when in the deployed position thereby to prevent the locking sleeve moving axially away from the first tubular body which would otherwise allow the locking members to move outwardly away from the first tubular body and disconnect the same from the second tubular body. When the retaining member is in the retracted position the locking sleeve is suitably unconstrained in the axial direction to move away from the first tubular body.

Preferably the at least one retaining member is slideably engaged with the elongate member. Suitably the retaining member is moved outwardly in its lateral slot by the elongate member when the same is moved axially by the motor. Suitably the elongate member may comprise a projecting portion which engages with the retaining member to force the same outwardly towards the deployed position. Alternatively or additionally, the elongate member may comprise a reduced portion having a reduced diameter, for example, into which the at least one retaining member may fall laterally into when the reduced portion is moved adjacent to and in lateral alignment with the retaining member by the motor. The projecting portion of the elongate member then forces the retaining member outwardly when the reduced portion is moved axially away from the retaining member to move the same out of lateral alignment. Preferably two reduced portions of the elongate member define the projecting portion therebetween.

The retaining member may be an annular spring collar which is biased towards the retracted position and forced outwardly by the elongate member towards the deployed position. Alternatively and preferably, the retaining member comprises at least two retaining members each mounted in corresponding lateral slots of the locking sleeve and arranged opposite each other relative to a longitudinal axis of the device. Suitably each retaining member may be arcuate and extend about approximately ninety degrees relative to the longitudinal axis of the device.

Preferably the elongate member comprises a longitudinal slot provided between the projecting portion and its second end for a cap screw to engage. The cap screw prevents the locking sleeve rotating on the elongate member whilst allowing the elongate member to move axially relative to the locking sleeve. Suitably the length of the slot determines the axial travel of the elongate member relative to the locking sleeve. When a limit of the slot engages with the cap screw as the elongate member is moved axially relative to the locking sleeve, the locking sleeve will be moved with the elongate member towards a second end of the second tubular body.

Suitably an internal shoulder of the locking sleeve may also provide a limit to the elongate member when moving relative to the locking sleeve. Preferably the shoulder is adapted to engage with the projecting portion of the elongate member after retraction of the retaining members so that on engagement with the shoulder the locking sleeve is moved with the elongate member towards the second end of the second tubular body.

An embodiment of the present invention will now be described by way of example only with reference to the accompanying drawings in which:

FIG. 1 shows a cross section through a disconnect device in accordance with the present invention in a fully connected state;

FIGS. 2*a* to 2*d* show the different stages during disconnection;

FIG. 2*e* shows the device in a fully disconnected state;

FIG. 2*f* shows a close up of the disconnect mechanism of the disconnect device;

FIG. 5 shows the locking sleeve of the disconnect mechanism;

FIG. 6 shows the retaining segments of the disconnect mechanism;

FIG. 8 shows the locking segments of the disconnect mechanism; and

FIG. 9 shows the upper portion of the lower body of the device.

Figure 1:
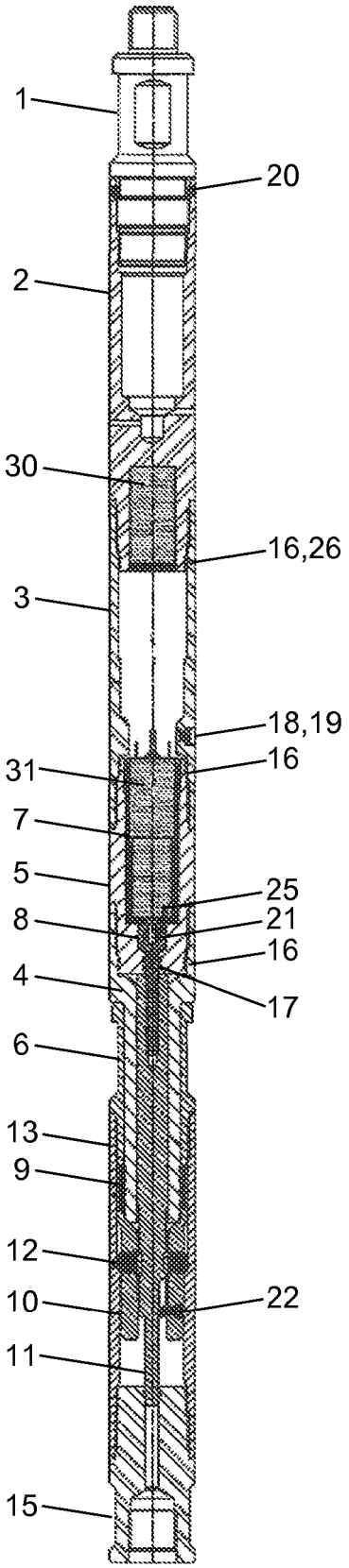

As shown in FIG. 1, a downhole disconnect device comprises three main tubular body portions; an upper tubular body 2, a middle tubular body 3,5,4 and a lower tubular body 6,13. The terms 'upper' and 'lower' are of course relative to the orientation of the device when in use.

A fishing neck 1 connects to an upper end of the upper body for a wireline, slickline or electric line, or similar, to securely attach and one or more screws 20 hold the same securely in place. An intervention tool (not shown) is directly or indirectly connectable to a lower end of the lower body 13. For example, part of a bottom assembly 15 or tool string comprising an intervention tool may attach to the lower end of the lower body 13.

The upper body may include an alarm system (not shown) adapted to alert an operator when the device is at or near the ground when being winched to the surface. Such an alarm system may comprise one or more magnets housed inside the upper body which cooperate with one or more sensors mounted in the wellbore at or near ground level. The upper body houses a motion sensor (not shown) such as an accelerometer or similar adapted to detect when the device is stationary and importantly when an intervention tool coupled to the same is stuck. The upper body also houses an onboard power source 30 such as a battery pack to power the demanding components of the device as will be further described below.

The upper body 2 is optional, for example when the alarm system is not required, wherein the fishing neck 1 for a wireline or similar to attach could extend from the middle body 3 which would house the motion sensor.

The middle body 3, 5, 4 comprises an upper portion 3, an intermediate portion 5 and a lower portion 4. The portions 3, 5, 4 threadably connect together to form the middle body. The upper portion 3 houses a controller (not shown) adapted to receive an output signal from the motion sensor and selectively operate an electric motor 31 axially mounted in the intermediate portion 5. The motor 31 sits in a motor jacket 7 which lines an axial bore of the intermediate portion 5. The jacket 7 is threadably received by the intermediate portion. The motor 31 is rotatably constrained in jacket 7 by screw 25 or similar. The motor 31 drives a driveshaft 8 which is coupled to the same by screw 21 or similar. A gear arrangement may be provided between the motor and driveshaft if required. The driveshaft 8 comprises a worm gear which extends from a lower end of the intermediate portion 5. Optionally, a joint (not shown) may be provided between the driveshaft 8 and the worm gear and/or between the motor 31 and the driveshaft 8 and further optionally, the said joint may be flexible and/or may be a universal joint (not shown) allowing a degree of flexibility in the alignment of said components.

The driveshaft 8 may connect to a protruding or male output rotor of the motor 31 or the driveshaft 8 may be inserted into a recessed or box output rotor (not shown) of the motor 31 for additional robustness in the field.

One or more O-rings 17 seal the interface between the driveshaft and the intermediate portion. The driveshaft 8 may be mounted therein by one or more bearings. The lower portion 4 of the middle body connects over the lower end of the intermediate portion 5. One or more O-rings 16 seal this interface. The lower portion 4 comprises a lower elongate end 35 having a reduced outer diameter relative to its upper end. The reduced elongate end 35 is slideably received by the lower tubular body 6.

Figure 3:
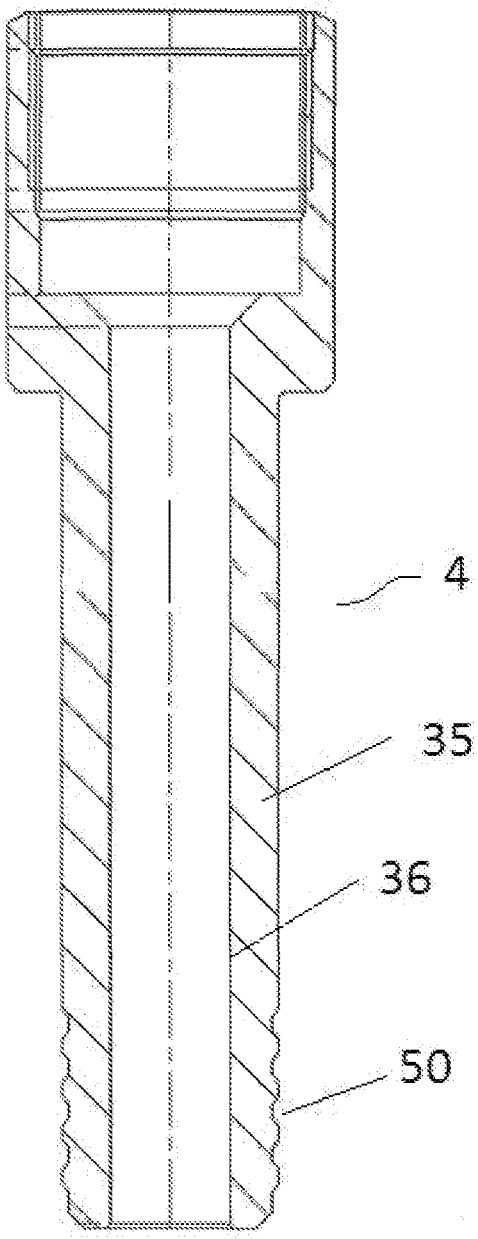
FIG. 3 shows the lower portion of the middle body of the device.
Figure 4:
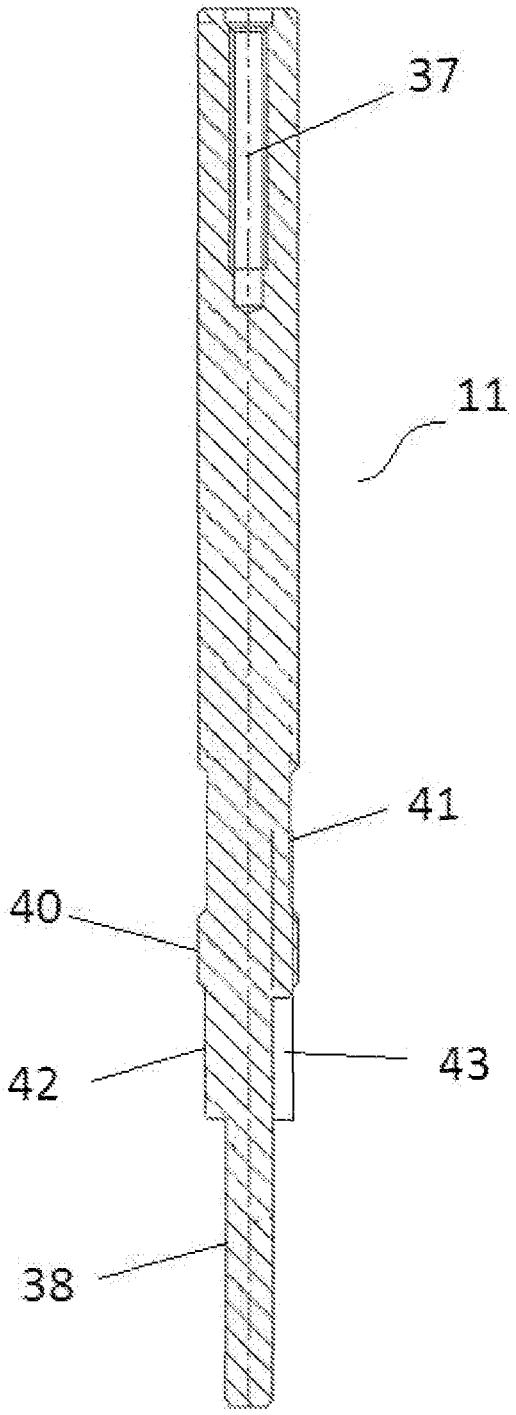
FIG. 4 shows the locking mandrel of the disconnect mechanism.

The reduced elongate end 35 of lower portion 4 (shown alone in FIG. 3) comprises a longitudinal bore 36 for slideably receiving an elongate locking mandrel 11 which threadably engages with driveshaft 8. The locking mandrel 11 (shown alone in FIG. 4) comprises a threaded bore 37 at a first end and a reduced second end 38. The locking mandrel 11 has a projecting portion 40 defined by two adjacent reduced portions 41,42.

The locking mandrel 11 is rotatably constrained relative to the lower body 6,13 by cap screw 22 which engages in a longitudinal slot 43 of the mandrel 11 whilst allowing the same to move axially in the lower body. In use, clockwise rotation of the driveshaft 8 by the motor 31 causes axial movement of the mandrel 11 in a first axial direction and counterclockwise rotation of the driveshaft 8 by the motor 31 causes axial movement of the mandrel in the other axial direction.

A locking sleeve 10 (shown alone in FIG. 5) is axially and slideably arranged in the lower body 4 and is slideably coupled to the mandrel 11 proximal a free end of the same. The projecting portion 40 of the mandrel 11 engages with an inner radial shoulder 44 of the locking sleeve to move the sleeve 10 with the mandrel 11 when the mandrel is moved downwardly in use by the motor. The shoulder 44 thereby provides a limit to the axial movement of the mandrel relative to the sleeve before the same move together. The cap screw 22 and slot 43 arrangement may also provide such a limit.

The locking sleeve 10 comprises two lateral slots 45 oppositely arranged relative to a longitudinal axis 46 of the sleeve in which a corresponding retainer segment 12 (shown alone in FIG. 6) is slideably mounted and unconstrained in the lateral direction. Each segment 12 is arcuate and extends about ninety degrees.

Figure 7:
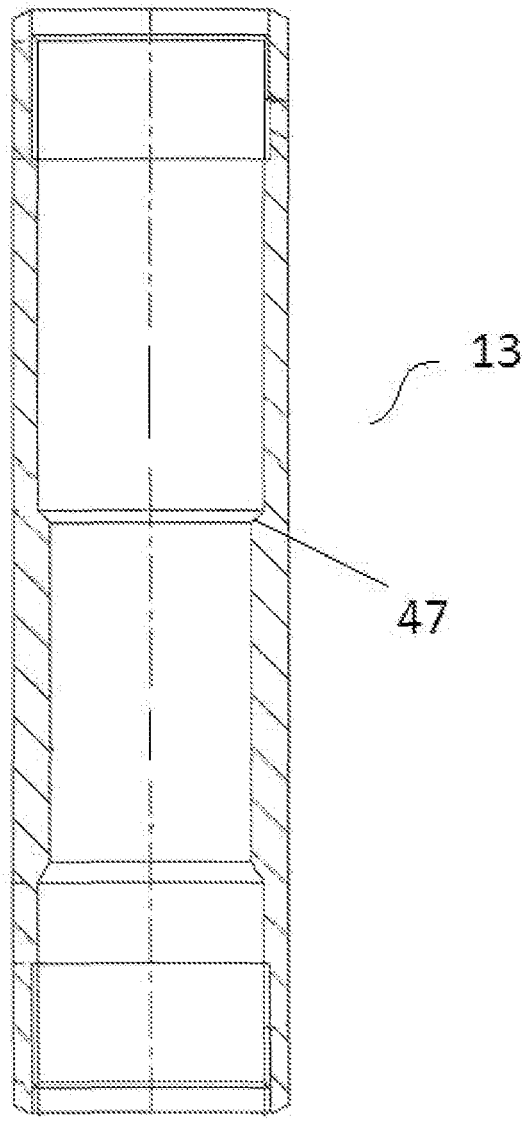
FIG. 7 shows the lower portion of the lower body of the device.

The projecting portion 40 of the mandrel 11 engages with each retaining segment 12 to force the same outwardly to engage with an internal retaining shoulder 47 of the lower tubular body 13 (shown alone in FIG. 7). When the retaining segments 12 are in a deployed position and engaged with the retaining shoulder 47 of the lower body 13, the sleeve 10 is constrained in a downward axial direction. The sleeve 10 is constrained in an upward axial direction by an upper shoulder 48 of the lower body 6,13 (see FIG. 2*f*). This shoulder 48 is provided by an end of lower body portion 6 when connected to lower body portion 13 to form the lower body 6,13. Alternatively, the lower body may be one piece and such a shoulder may be an internal machined shoulder.

When the mandrel 11 is moved axially downwardly by the motor 31 and worm gear arrangement 8, the projecting portion 40 thereof is moved downwardly away from the retaining segments 12. This allows the segments to move inwardly in their corresponding slots of the locking sleeve 10 and to disengage from the shoulder 47 of the lower body 13. The locking sleeve 10 is then unconstrained in the axial downward direction so when the projecting portion 40 of the mandrel 11 engages with the radial shoulder 44 of the sleeve 10, and/or the cap screw 22 reaches its limit in corresponding slot 43 of the mandrel 11, both the mandrel and sleeve continue to move together in a downward axial direction.

Figures 2A, 2B, 2C, 2D:
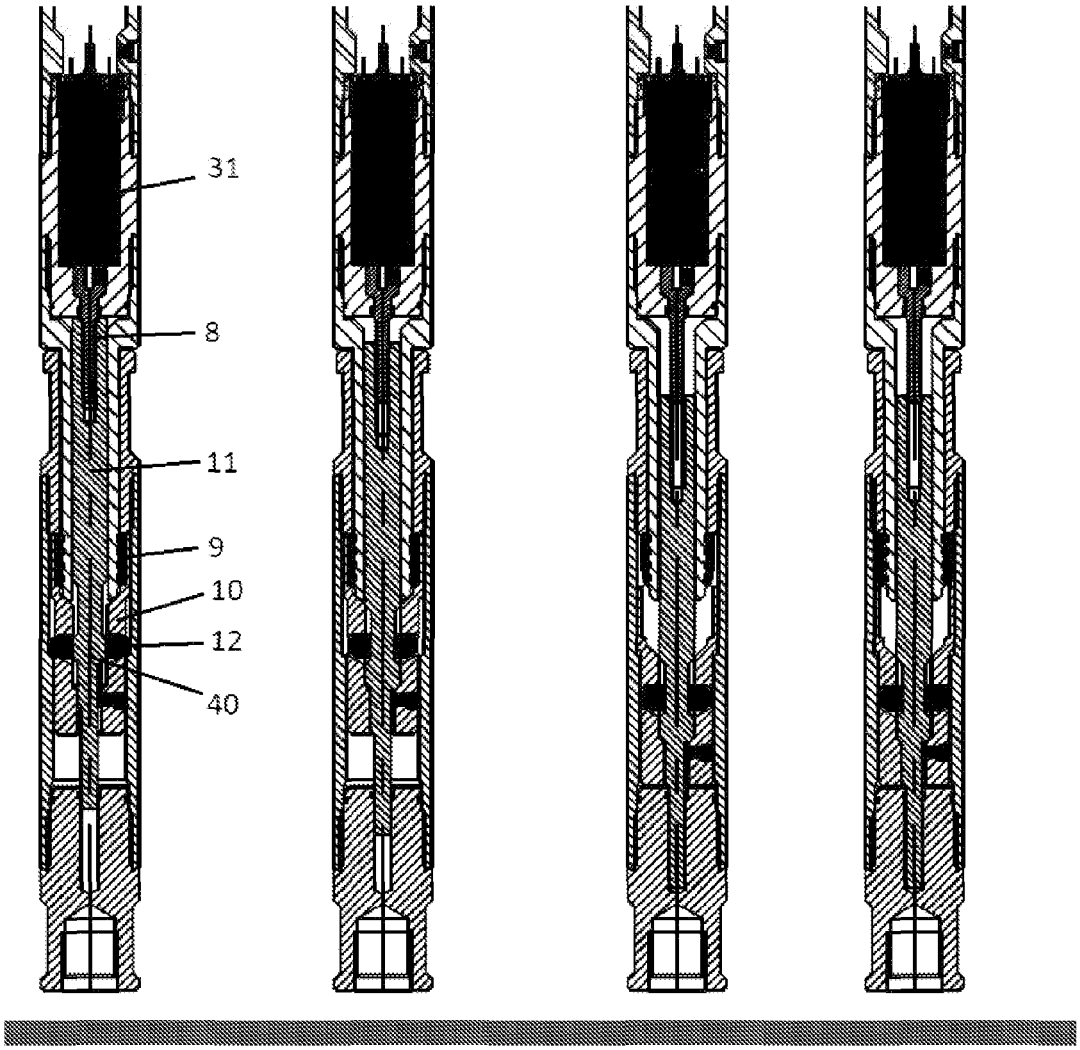

As shown in FIGS. 1 and 2*a* which both show the device in a connected state, three locking segments 9 (shown alone in FIG. 8) are provided above the locking sleeve 10 and are arranged to be sandwiched between the locking sleeve 10 and the mandrel 11 when the sleeve is in an upper locked position. Each locking segment 9 comprises a plurality of inwardly extending radial projections and recesses 49 which correspondingly engage with projections and recesses 50 on the outer surface of the reduced end 35 of lower middle portion 4 (shown alone in FIG. 3).

When in a locked position, the locking sleeve 10 forces the locking segments 9 against the reduced portion 4 of the middle body to securely connect the lower body 6,13 to the middle body 3,5,4 and upper body 2. The locking segments 9 are constrained axially in the locked position by the sleeve 10 and the upper shoulder 48 provided by the connection between the two lower body portions 6,13.

As shown in FIG. 2*b*, downward movement of the mandrel 11 by the motor 31 and worm gear arrangement 8 causes the projecting portion 40 of the mandrel to move downwardly away from the retaining segments 12 to allow the same to move laterally inwardly. This disengages the retaining segments 12 from the lower body 13. This is the initial stage of disconnect. The mandrel 11 continues to move downwardly relative to the sleeve 10 until the projecting portion 40 of the mandrel 11 engages lower shoulder 44 of the sleeve 10 and/or the cap screw 22 reaches its limit in corresponding slot 43 of the mandrel 11.

The locking sleeve 10 is now allowed to move downwardly with the mandrel as shown in FIG. 2*c* until the sleeve reaches a limit at the bottom of the lower body 13. As shown in FIG. 2*c*, such downward movement of the locking sleeve 10 creates a space above its upper end. The locking segments 9 are now unconstrained laterally and are allowed to drop into this space and outwardly away from the reduced portion 35 of the middle body 4. The locking segments 9 are thereby disengaged from the middle body 4 as shown in FIG. 2*d*.

Figure 2E:
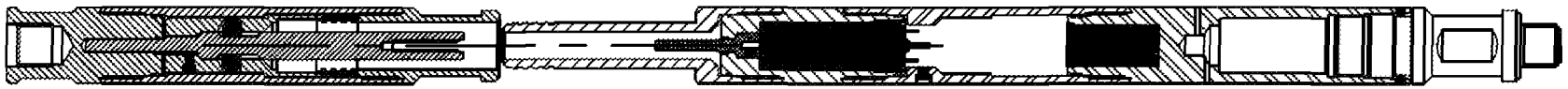
Figure 2F:
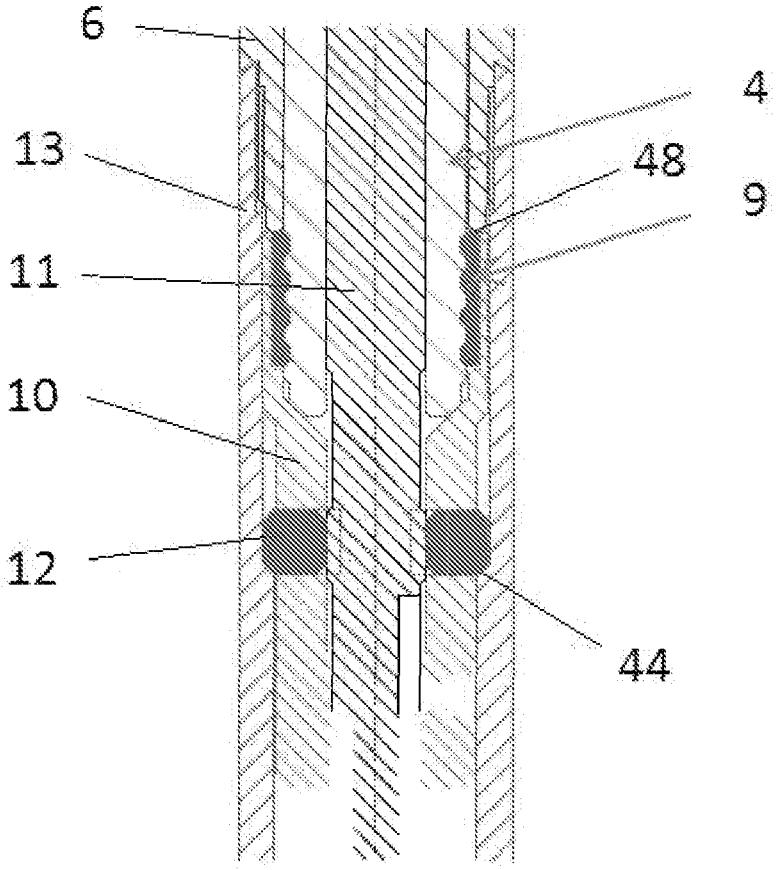

As shown in FIG. 2*e*, further rotation of the drive shaft 8 disengages the same from the locking mandrel 11 and the middle 3,5,4 and upper bodies 2 are free to be lifted from the lower body 6,13. The mandrel 11, sleeve 10, retaining segments 12 and locking segments 9 remain in the lower body 6,13.

The upper end of the lower body portion 6 (shown alone in FIG. 9) comprises an external flanged portion 60 providing an industry standard external fish neck 60 for a suitable fishing tool to recover the lower body 6, 13 and attached intervention tool. This allows for a stuck intervention tool to be efficiently recovered with standard fishing equipment without the wireline or similar and/or tool itself being compromised further ensuring the cost and time for recovering a stuck tool is kept to a minimum. A centraliser (not shown) may be provided in close proximity to the fishing neck 60 to centralise the fishing neck 60 within the well to aid subsequent fishing/recovery of the lower body portion 6 and intervention tool.

The automatic control operation of the downhole disconnect device as described above will now be described. In use, the downhole disconnect device may form part of a tool string suspended in a wellbore from a wireline or similar. An intervention tool directly or indirectly attached to the disconnect device may become stuck in the wellbore. The motion sensor of the device will detect when the tool is stuck and will output a signal to the onboard controller. The controller may comprise an electrical circuit board and is in operative communication with the electric motor 31. The controller includes a timer, such as a timer chip, which is programmable to select a desired time delay, whereby on receipt of the output signal from the sensor, the controller delays operating the motor 31 by the desired time delay. The timer may be programmable to any time delay period and/or may comprise a plurality of preset time delay periods for selection. After the desired time delay period has expired, such as after eight hours, the controller automatically operates the motor 31 which in turn drives the worm gear 8 to axially move the locking mandrel 11 downwardly to move the locking sleeve 10 and disengage the locking segments 9 from the middle body 4, as described above, to disconnect the lower body 6,12 and tool (not shown) from the upper and middle bodies of the device. The time delay desirably allows for the tool string to be purposively left by an operator in the event of a stuck intervention tool for the desired period of time before the motor is operated automatically. This prevents accidental disconnection of the tool from the tool string which could occur when, for example, a further signal is required by an operator to disconnect the tool. Furthermore, any movement of the tool string and therefore the device will be detected by the motion sensor and the time delay will be cancelled to prevent disconnection of the tool therefrom. Such further movement may indicate the tool string is still in normal operation and the tool itself is not stuck, for example where an intervention operation has been paused for a certain amount of time not exceeding the time delay period. Further conveniently, a clean industry standard fishing neck is provided on the upper end of the lower body after disconnection to allow a suitable fishing tool to easily and securely attach to efficiently recover a stuck tool from the wellbore.

Modifications and improvements may be made to the above-described embodiments without departing from the scope of the invention. For example, the drive assembly/mechanism described above may be employed in applications other than a downhole disconnect device for disconnecting a wireline from a stuck intervention tool. Such other applications may include anchoring a subassembly in a wellbore for performing intervention operations (or other operations such as monitoring operations) or engaging a fishing tool to a stuck intervention tool. An example of a monitoring operation could be provided by a subassembly comprising a drive assembly according to the present invention where the worm gear arrangement is arranged to move a mandrel or other driven member in an axial direction which, in turn, moves one or more locking keys or slips outwardly in a radial direction to be forced against the inner wall of a casing or liner string to anchor the subassembly in a desired position in a wellbore. One or more gauges may extend or hang from the anchored subassembly for monitoring flow rates of gas or oil, for example, entering the wellbore via perforations formed in the inner wall of a casing or liner string.

The invention claimed is:

1. A downhole disconnect device for disconnecting an intervention tool string from a wireline, said device comprising:

a tubular body having a first part directly or indirectly coupleable to the wireline and a second part connectable directly or indirectly to an intervention tool string;

an actuator for disconnecting the second part of the tubular body from the first part of the tubular body;

at least one sensor to detect when the tool string is stuck in use and to produce an output signal accordingly;

a controller configured to receive the output signal and selectively operate the actuator accordingly; and a power source;

wherein the tubular body is adapted to house the actuator, sensor, controller and power source and wherein the device further comprises a timer configured to delay operation of the actuator by a predetermined time on receipt of the output signal from the sensor, wherein the first part comprises a first tubular body and the second part comprises a second tubular body wherein the first tubular body is releasably connected to the second tubular body where, in use in a vertical wellbore, the second tubular body is disposed below the first tubular body, and at least the actuator, power source, sensor and controller are housed in the first tubular body and a disconnect mechanism is at least partially housed in the second tubular body, wherein the actuator is a motor which rotatably drives a drive shaft engageable with the disconnect mechanism, wherein the disconnect mechanism comprises an axially disposed elongate member having a first end engageable with the drive shaft and a second end, wherein the elongate member is slidably mounted in at least the second tubular body to move in an axial direction and the elongate member is prevented from rotating by a constraint while being allowed to move axially, wherein the first end of the elongate member comprises a threaded bore corresponding to a screw thread on the drive shaft thereby to cause the elongate member to move in an axial direction on rotation of the drive shaft by the motor, wherein the elongate member is further supported by the first tubular body when the first and second tubular bodies are connected, wherein the disconnect mechanism comprises at least one locking member to lock the first and second tubular bodies together during normal operating conditions and a locking sleeve slideably and axially arranged inside the second tubular body and having a throughbore to slideably receive the second end of the elongate member, wherein a first end of the locking sleeve is adapted to receive a portion of the second end of the first tubular body when the first and second tubular bodies are connected, and wherein the at least one locking member is arranged between the second end portion of the first tubular body and the first end of the locking sleeve, wherein the at least one locking member slideably engages with an inner surface of the locking sleeve while being lockably engagable with the first tubular body, wherein the locking sleeve is coupled to the elongate member thereby to move axially therewith when driven by the motor, wherein the disconnect mechanism is adapted to axially move the locking sleeve a limited distance corresponding to a space required for the at least one locking member to move laterally outwardly into the space while providing a limit to the at least one locking member in the axial direction, and wherein a first end of the locking sleeve provides the axial limit when the locking members are in an outwardly unlocked position.

2. A downhole disconnect device according to claim 1 wherein the sensor, power source and actuator are axially aligned within the tubular body.

3. A downhole disconnect device according to claim 1 wherein the sensor comprises an accelerometer.

4. A downhole disconnect device according to claim 1 wherein the timer is programmable to allow the timer to be selectively programmed to a predetermined time period.

5. A downhole disconnect device according to claim 1 wherein the power source comprises a battery, and wherein the electrical motor drives the disconnect mechanism to disconnect the second part from the first part.

6. A downhole disconnect device according to claim 1 wherein the device comprises an attachment member provided at an upper end of the tubular body for attaching a wireline directly thereto, wherein the attachment member is axially aligned with the tubular body.

7. A downhole disconnect device according to claim 1 wherein the at least one locking member is constrained in an axial direction by an annular shoulder of the locking sleeve and a first annular shoulder of the second tubular body when the first and second bodies are connected; and the at least one locking member comprises a plurality of ridges to define a plurality of channels which correspond to annular ridges and channels of the second end portion of the first tubular body; and the at least one locking member comprises three locking segments each extending about approximately 120 degrees relative to the longitudinal axis of the device.

8. A downhole disconnect device according to claim 1 wherein an upper first end of the second tubular body comprises a standard connection for a fishing tool to engage with after disconnection of the first tubular body therefrom; and a lower second end of the second tubular body comprises a screw thread mechanism for receiving and connecting to a corresponding screw thread mechanism of a bottom assembly or an intervention tool.

9. A downhole disconnect device according to claim 1 further comprising a recovery alarm system which indicates when a tool string comprising an intervention tool has reached/passed ground level and wherein the device comprises a sensor of the alarm system for detecting when the device has reached/passed ground level to alert an operator accordingly.

10. A downhole disconnect device for disconnecting an intervention tool string from a wireline, said device comprising:

a tubular body having a first part directly or indirectly coupleable to the wireline and a second part connectable directly or indirectly to an intervention tool string;

an actuator for disconnecting the second part of the tubular body from the first part of the tubular body;

at least one sensor to detect when the tool string is stuck in use and to produce an output signal accordingly;

a controller configured to receive the output signal and selectively operate the actuator accordingly; and a power source;

wherein the tubular body is adapted to house the actuator, sensor, controller and power source and wherein the device further comprises a timer configured to delay operation of the actuator by a predetermined time on receipt of the output signal from the sensor, wherein the first part comprises a first tubular body and the second part comprises a second tubular body wherein the first tubular body is releasably connected to the second tubular body where, in use in a vertical wellbore, the second tubular body is disposed below the first tubular body; and at least the actuator, power source, sensor and controller are housed in the first tubular body and a disconnect mechanism is at least partially housed in the second tubular body, wherein the actuator is a motor which rotatably drives a drive shaft engageable with the disconnect mechanism, wherein the disconnect mechanism comprises an axially disposed elongate member having a first end engageable with the drive shaft and a second end, wherein the elongate member is slidably mounted in at least the second tubular body to move in an axial direction and the elongate member is prevented from rotating by a constraint while being allowed to move axially, wherein the first end of the elongate member comprises a threaded bore corresponding to a screw thread on the drive shaft thereby to cause the elongate member to move in an axial direction on rotation of the drive shaft by the motor;

wherein the elongate member is further supported by the first tubular body when the first and second tubular bodies are connected;

wherein the disconnect mechanism comprises at least one locking member to lock the first and second tubular bodies together during normal operating conditions and a locking sleeve slideably and axially arranged inside the second tubular body and having a throughbore to slideably receive the second end of the elongate member, wherein a first end of the locking sleeve is adapted to receive a portion of the second end of the first tubular body when the first and second tubular bodies are connected, wherein the at least one locking member is arranged between the second end portion of the first tubular body and the first end of the locking sleeve, wherein the at least one locking member slideably engages with an inner surface of the locking sleeve while being lockably engagable with the first tubular body, wherein the disconnect mechanism further comprises a secondary locking means, wherein the secondary locking means comprises at least one retaining member mounted in a corresponding lateral through-slot of the locking sleeve; and the retaining member is outwardly moveable in a lateral direction relative to a longitudinal axis of the device from a deployed position to a retracted position, and vice versa, while being constrained axially by the lateral slot.

11. A downhole disconnect device according to claim 10 wherein the at least one retaining member engages with a second shoulder of the second tubular body when in the deployed position thereby to prevent the locking sleeve moving axially away from the first tubular body;

wherein the at least one retaining member is slideably engaged with the elongate member; and wherein the retaining member is moved outwardly in its lateral slot by the elongate member when the same is moved axially by the motor; and wherein the elongate member comprises an enlarged portion which engages with the retaining member to force the same outwardly towards the deployed position.

12. A downhole disconnect device according to claim 10 wherein the at least one retaining member comprises at least two retaining members each mounted in corresponding lateral slots of the locking sleeve and arranged opposite each other relative to a longitudinal axis of the device;

wherein the elongate member comprises a longitudinal slot provided between the enlarged portion and its second end for a cap screw device or similar to engage;

and an internal shoulder of the locking sleeve provides a limit to the elongate member when moving relative to the locking sleeve, the shoulder being adapted to engage with the enlarged portion of the elongate member so that, on engagement with the shoulder, the locking sleeve is moved with the elongate member towards the second end of the second tubular body;

wherein the first tubular body comprises a reduced elongate portion which is received by the second tubular body to allow the first and second bodies to slideably engage with each other; and the reduced elongate portion of the first body supports and guides the elongate member of the disconnect mechanism when the first and second tubular bodies are connected and during disconnection thereof.

13. A downhole disconnect device for disconnecting an intervention tool from a wireline, said device comprising:

a motor axially mounted in a first tubular body having a drive shaft extending from a first end thereof;

a power source disposed in the first tubular body;

a sensor disposed in the first tubular body for detecting when the device is motionless and transmitting an output signal based thereon;

a controller disposed in the first tubular body for receiving the output signal and configured to delay operation of the motor on receipt of the output signal by a predetermined time;

wherein the drive shaft is engageable with a disconnect member slideably mounted and axially arranged in a second tubular body of the device whereby rotation of the drive shaft by the motor causes axial movement of the disconnect member;

a locking sleeve;

a first and a secondary locking means;

the first locking means comprising at least one first locking member to lock the first and second tubular bodies together, wherein the locking sleeve forces the said at least one first locking member against a portion of the first tubular body to securely connect the first tubular body to the second tubular body, when in a deployed locked configuration;

and the secondary locking means comprising one or more second locking members adapted to constrain the locking sleeve in an axial direction with respect to the second tubular body when in a deployed locked configuration;

wherein the disconnect member is coupled to at least one of the second locking members which in turn is engageable with the second tubular body when in the deployed locked configuration to connect the first and second tubular bodies together, while allowing, upon movement of the disconnect member in an axial direction, the first and second tubular bodies to be disconnected when, firstly, the second locking member is in a retracted position such that the locking sleeve is no longer constrained in the axial direction and the disconnect device is in an initial stage of disconnect;

and continued movement of the disconnect member in the axial direction moves the locking sleeve in the axial direction such that the first locking members are unconstrained by the locking sleeve and thereby disengage from the first tubular body;

the first tubular body being directly or indirectly connectable to a wireline and the second tubular body being directly or indirectly coupleable to an intervention tool.

14. A method of disconnecting an intervention tool string from a wireline when the same becomes stuck in a wellbore, the method comprising the steps of:

providing a downhole disconnect device according to claim 13;

sensing when at least a portion of the intervention tool string is stuck in the well bore;

transmitting an output signal from the sensor to the controller;

delaying operation of the actuator by a predetermined time on receipt of the output signal by the controller; and automatically operating the actuator on expiry of the predetermined time to disconnect the second part of the tubular body from the first part of the tubular body.

15. A method according to claim 14 further comprising one or more of the following steps:

recovering the device to ground level;

lowering a fishing tool to the stuck intervention tool;

engaging the fishing tool with the intervention tool;

recovering the fishing tool and intervention tool to ground level; and detecting when the device and/or fishing tool and/or intervention tool has reached/passed ground level during a corresponding recovery step.

16. A downhole disconnect device according to claim 13, wherein the sensor comprises an accelerometer further comprising a timer configured to delay operation of the actuator by the predetermined time on receipt of the output signal, the timer being programmable to allow the timer to be selectively programmed to a predetermined time period.

17. A downhole disconnect device according to claim 13, wherein the disconnect member is slidably mounted in at least the second tubular body to move in an axial direction and wherein the disconnect member is prevented from rotating by a constraint while being allowed to move axially and wherein the first end of the disconnect member comprises a threaded bore corresponding to a screw thread on the drive shaft thereby to cause the disconnect member to move in an axial direction on rotation of the drive shaft.

18. A downhole disconnect device according to claim 13, wherein the disconnect member comprises an axially disposed elongate member having a first end engageable with the drive shaft and a second end, wherein the locking sleeve is slideably and axially arranged inside the second tubular body and has a throughbore to slideably receive the second end of the elongate member, and wherein the locking sleeve is located, when the device is in the deployed locked configuration in between the first tubular body and the second tubular body.

19. A downhole disconnect device according to claim 18, wherein a first end of the locking sleeve is adapted to receive a portion of the second end of the first tubular body when the first and second tubular bodies are connected and wherein the first locking member is arranged between the second end portion of the first tubular body and the first end of the locking sleeve and wherein the first locking member slideably engages with an inner surface of the locking sleeve whilst being lockably engagable with the first tubular body.

20. A downhole disconnect device according to claim 13, wherein the first locking member is constrained in an axial direction by an annular shoulder of the locking sleeve and a first annular shoulder of the second tubular body when the first and second tubular bodies are connected.

21. A downhole disconnect device according to claim 13, wherein the first locking member comprises a plurality of ridges to define a plurality of channels which correspond to annular ridges and channels of the second end portion of the first tubular body and wherein the at least one first locking member comprises at least two arcuate locking segments.

22. A downhole disconnect device according to claim 13, wherein the locking sleeve is coupled to the disconnect member thereby to move axially therewith when driven by the actuator and wherein the disconnect member is adapted to axially move the locking sleeve a limited distance corresponding to a space required for the first locking members to move laterally outwardly into the space while providing a limit to the first locking members in the axial direction and wherein a first end of the locking sleeve provides the axial limit when the first locking members are in an outwardly unlocked position.

23. A downhole disconnect device according to claim 13, wherein the one or more second locking members are mounted in a corresponding lateral through-slot of the locking sleeve.

24. A downhole disconnect device according to claim 23, wherein each of the said one or more second locking members is outwardly moveable in a lateral direction relative to a longitudinal axis of the device from a deployed position to a retracted position, and vice versa, while being constrained axially by the lateral slot and wherein each of the said second locking members engage with a second shoulder of the second tubular body when in the deployed position thereby to prevent the locking sleeve moving axially away from the first tubular body.

25. A downhole disconnect device according to claim 24, wherein the at least one second locking member is slideably engaged with the disconnect member and each of the said second locking members is moveable in a lateral direction relative to a longitudinal axis of the device from a deployed position to a retracted position, and vice versa, while being constrained axially by the lateral slot, by the disconnect member when the same is moved axially by the actuator and wherein the disconnect member comprises an enlarged portion which engages with each of the second locking members to force the same outwardly towards the deployed position.

26. A downhole disconnect device according to claim 25, wherein an internal shoulder of the locking sleeve provides a limit to the disconnect member when moving relative to the locking sleeve, the shoulder being adapted to engage with the enlarged portion of the disconnect member so that, on engagement with the shoulder, the locking sleeve is moved with the disconnect member towards the second end of the second tubular body.

27. A downhole disconnect device according to claim 13, wherein an upper first end of the second tubular body comprises a standard connection for a fishing tool to engage with after disconnection of the first tubular body therefrom and wherein a lower second end of the second tubular body comprises a screw thread mechanism for receiving and connecting to a corresponding screw thread mechanism of a bottom assembly or an intervention tool.

28. A downhole disconnect device according to claim 13, further comprising a recovery alarm system which indicates when a tool string comprising an intervention tool has reached/passed ground level and wherein the device comprises a sensor of the alarm system for detecting when the device has reached/passed ground level to alert an operator accordingly.

* * * * *